US006265669B1

(12) United States Patent
Richards

(10) Patent No.: US 6,265,669 B1
(45) Date of Patent: Jul. 24, 2001

(54) SEMICONDUCTIVE ATTACHMENT DISC FOR INSULATORS TO REDUCE ELECTRICAL STRESS-INDUCED CORROSION

(76) Inventor: Clyde N. Richards, P.O. Box 216, Peralta, NM (US) 87042

( * ) Notice: Subject to any disclaimer, the term of this patent is extended or adjusted under 35 U.S.C. 154(b) by 503 days.

(21) Appl. No.: 08/695,899

(22) Filed: Aug. 12, 1996

(51) Int. Cl.[7] ..... H01B 17/42

(52) U.S. Cl. ..... 174/140 R; 174/140 CR; 174/176; 174/140 C; 174/141 C

(58) Field of Search ..... 174/140 R, 141 C, 174/141 R, 144, 140 C, 140 S, 140 CR, 176, 177, 181, 156, 179

(56) References Cited

U.S. PATENT DOCUMENTS

| | | | | |
|---|---|---|---|---|
| 909,569 | * | 1/1909 | Ette | 191/42 |
| 1,225,587 | * | 5/1917 | Creighton | 361/132 |
| 1,706,488 | | 3/1929 | Hawley | 174/139 |
| 2,023,808 | * | 12/1935 | Hawley | 174/140 C |
| 2,947,801 | | 8/1960 | Doolittle | 174/141 B |
| 3,194,879 | * | 7/1965 | Hopwood | 174/140 C |
| 3,243,505 | * | 3/1966 | Clark | 174/140 C |
| 3,791,859 | * | 2/1974 | Hirayama | 174/144 |
| 3,798,351 | * | 3/1974 | Tsuzuki et al. | 174/140 C |
| 4,234,757 | | 11/1980 | Simons | 174/73.1 |
| 4,267,403 | | 5/1981 | Pargamin | 174/140 S |
| 4,343,966 | | 8/1982 | Pargamin | 174/140 S |

FOREIGN PATENT DOCUMENTS

| | | | | |
|---|---|---|---|---|
| 586065 | * | 3/1947 | (GB) | 174/140 |

* cited by examiner

*Primary Examiner*—Albert W. Paladini
*Assistant Examiner*—Kamand Cuneo
(74) *Attorney, Agent, or Firm*—Robert W. Harris

(57) ABSTRACT

Insulator terminator device, for attachment to the top or bottom of a high voltage power line insulator having a conventional end fitting, for prevention of high surface leakage currents and corona discharges, and the corrosive and erosion effects produced thereby, so as to lengthen effective life of the insulator. The device, which attaches around the region of the juncture of the insulator and its end fitting, has a disk shaped semiconductor element with rounded edges, and a rounded-edged surface conduction and strength layer element fitting the bottom, sides, and outer portion of the top of the semiconductor disk element. Surface currents and corona discharges are prevented by shunting of current as volume current though the semiconductor disk and its surface conduction layer, directly to the end fitting of the insulator. The rounded geometry of the device also avoids any high field points which might otherwise produce corona discharges on the surface of the device.

16 Claims, 2 Drawing Sheets

SEMICONDUCTIVE ATTACHMENT DISC FOR INSULATORS TO REDUCE ELECTRICAL STRESS-INDUCED CORROSION

BACKGROUND OF THE INVENTION

The present invention pertains to high voltage insulators, of the type use on high voltage power transmission lines, and more specifically to devices intended to be used on ends of such insulators, to reduce or eliminate corrosion and erosion effects associated with current leakage and corona discharge effects.

It is well known in the high voltage insulator art that insulator end fittings are prone to erosion and corrosion effects associated directly or indirectly with high voltage current effects, particularly in the case of insulators having non-ceramic bodies. Such effects are typically caused by ultraviolet radiation created by corona discharges from surfaces under high electric field stress; and also by leakage currents flowing across the insulator surface and terminating on end fittings.

These corrosion and erosion effects eventually can cause increasing weakness of the insulator strength member, and can eventfully result in a mechanical and/or electrical failure of the insulator, thus materially shortening the useful insulator life, as compared with the life it would have absent such effects.

There is thus a need for a device which can effectively prevent such corona discharges so as to eliminate the ultraviolet radiation, and also terminate the surface leakage currents in a manner which eliminates insulator corrosion and erosion.

As detailed below, the present invention accomplishes these objectives by an insulator terminator having the combination of a semiconductor element, of the form of a disk with rounded edges, and a surface conductive element, covering about half of the semiconductor element, which elements together shield the portion of the insulator near the insulator end fitting from high electric field stress, and also eliminate surface leakage current from the part of the insulator near the insulator end fitting, by shunting such current flow through the semiconductor element and surface conductor element of the present invention device, directly to the end fitting of the insulator, which end fitting connects to the power cable, at the lower end of the insulator, and to the tower or pole structure at the upper end from whence it is connected electrically to ground potential.

SUMMARY OF THE INVENTION

The present invention is an insulator terminator device, for attachment to the conventional lower end fitting of a conventional high voltage insulator, for the purpose of extending insulator life by eliminating corrosion and erosion normally produced near the end fittings by high surface leakage currents, and ultraviolet radiation caused by corona discharges. The device, which attaches to the lower end fitting with the top of the device abutting the lower surface of the bottom rain shed of the insulator, has two split half elements formed of semiconductor material, together forming a generally tapered disk shaped structure having a rounded, smooth outer edge having no portion with a radius of curvature less than about an inch. The bottom, outer edge and outer portion of the top of each semiconductor split half has on its surface a highly conductive strength member, typically a metal such as aluminum. The entire device is attached by adhesive and clamping bolts to both sides of the insulator end fitting. High surface leakage currents and corona discharges are eliminated by the combined effect of the semiconductor and surface conductor elements of the device, as a result of the volume current which flows directly from the lowest rain shed through the semiconductor element to the surface conductive element of the device and thence directly to the end fitting, and because the lack of any sharp points on the surface conductive element prevents corona discharges. The net effect of the device is thus to shield the region near the end fitting from large electrical fields that can cause corrosion and erosion effects, even when the insulator is wet from rain. As detailed below, a device of substantially the same form may also be attached to the upper end of the high voltage insulator, at the upper end fitting.

BRIEF DESCRIPTION OF THE DRAWINGS

The same embodiment of the invention is shown in each of FIGS. 1–3 and 5.

FIG. 4 is a side elevational view of the high voltage insulator without the invention attached.

DESCRIPTION OF THE PREFERRED EMBODIMENT

Figure 1:
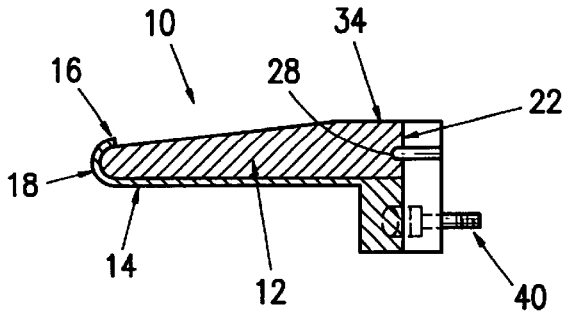
FIG. 1 is a section through the middle of one split half of the invention.
Figure 2:
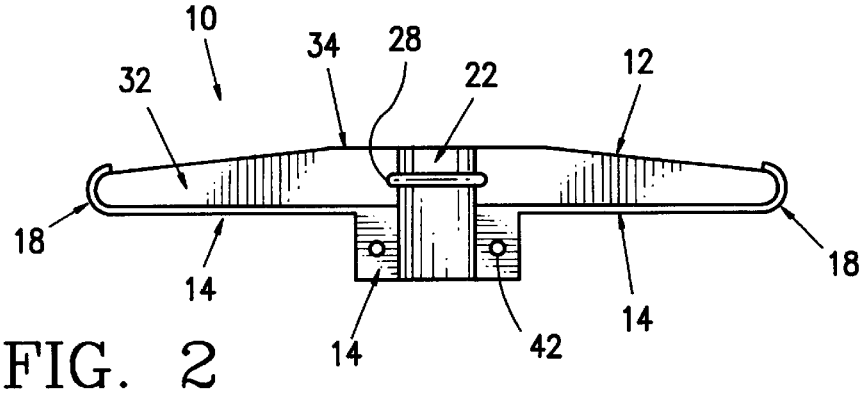
FIG. 2 is an elevational view of one split half of the invention, as seen looking toward the flat surface of the split half.
Figure 3:
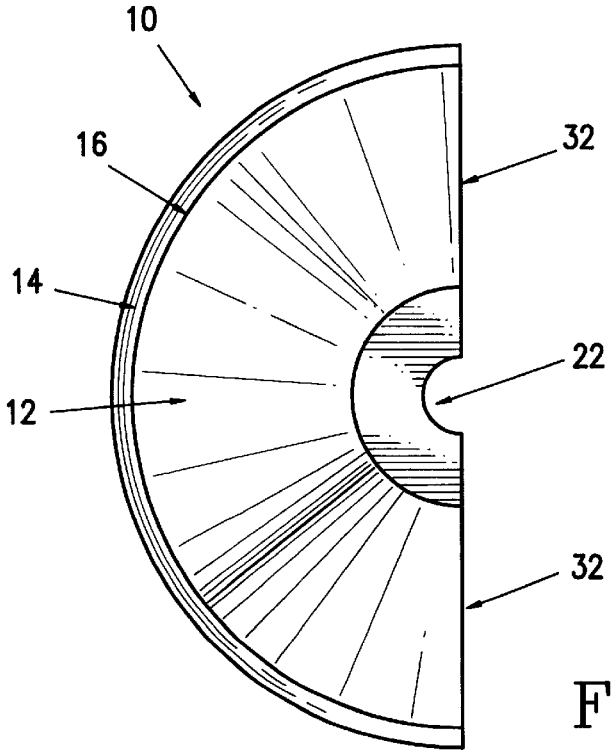
FIG. 3 is a plan view of one split half of the invention of the same preferred embodiment, the same device shown in the views of FIGS. 1 and 2.

Referring now to the drawings, in which like reference numbers denote like or corresponding elements, the invention has two identical split halves, 10. Each split half 10 has a semiconductor member 12, of the form of half of a disk having rounded edges, and a conductive strength member 14, configured to snugly cover the bottom, outer edge and outer portion of the top of semiconductor member 12 outside the point 16, which is near the outer edge of semiconductor member 12, and marks the inner boundary of the reach of conductive strength member 14 on the upper surface of semiconductor member 12, with the outer surface 18 of conductive strength member 14 having a smooth shape, as indicated in FIGS. 1 and 2, with no point of said surface having a radius of curvature less than about one inch. The semiconductor member 12 is formed of a semiconductor material having a conductivity of about 0.1 microSiemen/cm. The material used for semiconductor member 12 should be resistant to deterioration by sunlight, should not cause electrolytic corrosion of end fitting 20, (shown in FIG. 4) and should be flame resistant in case the insulator flashes over. There are many carbon-loaded or graphite-loaded resins which would be suitable. The conductive strength member 14 is formed of a highly conductive material, typically a metal such as aluminum. Other suitable choices for conductive strength member 14 would be galvanized steel, or stainless steel. The preferable material would provide sufficient strength and conductivity, and would be electrolytically compatible with the end fitting 20. The suitable conductivity would be greater than about 10,000 Siemen/cm.

The conductive strength member 14 and semiconductor member 12 are bonded together, either by casting semiconductor member 12 in conductive strength member 14 or by bonding them together with a suitable electrically conductive bonding agent.

Figure 4:
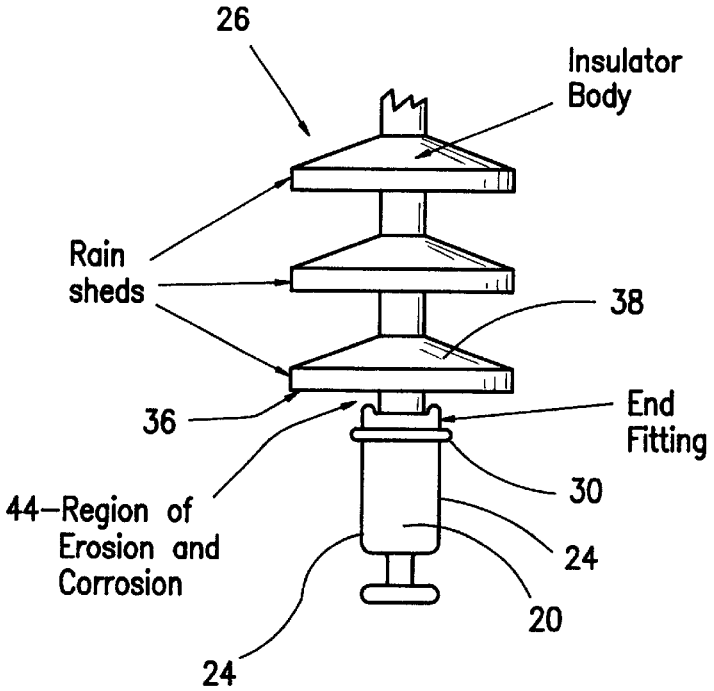
FIG. 4 shows an insulator without the invention attached.

The identical split halves 10 are formed with inner surfaces 22 configured to snugly fit the sides 24 of the end fitting 20, of a conventional high voltage insulator 26, with each of the inner surfaces 22 having a groove 28 matching the protuberance 30 (shown in FIG. 4) on the sides 24 of end fitting 20 (shown in FIG. 4). When the two split halves 10 are joined to the two sides of sides 24 of the end fitting 20, the split halves 10 meet on their side surfaces 32. The split halves 10 are configured with height such that the upper surfaces 34 of split halves 10 will be located just below the bottom 36 (shown in FIG. 4) of lowermost rain shed 38, of high voltage insulator 26 (shown in FIG. 4), when the split halves 10 are fitted to the sides 24 of end fitting 20.

To attach the split halves 10 of the insulator terminator device to the end fitting 20, the user first coats inner surfaces 22, surfaces 34 and surfaces 32, of split halves 10, with a thin layer of silicone rubber, grease or any other waterproof, nonconductive sealant. Then the split halves 10 are clamped to the high voltage insulator 26, using bolts 40 (shown in FIG. 4) through holes 42 in the bottom portions of each conductive strength member 14, and nuts (not shown) to secure bolts 40. The user than fills any void between surfaces 34 and the bottom 36 of rain shed 38 with waterproof sealant to make sure there is a watertight interface between top of the insulator terminator device and the bottom 36 of rain shed 38.

In the preferred embodiment, the split halves 10 are sized to form a disk about 11 inches in diameter, when assembled together on the two sides of the bottom of high voltage insulator 26. Although not apparent from the scale of the drawings, the height of the split halves 10 is only about 0.5" to 1.0", in the preferred embodiment.

Figure 5:
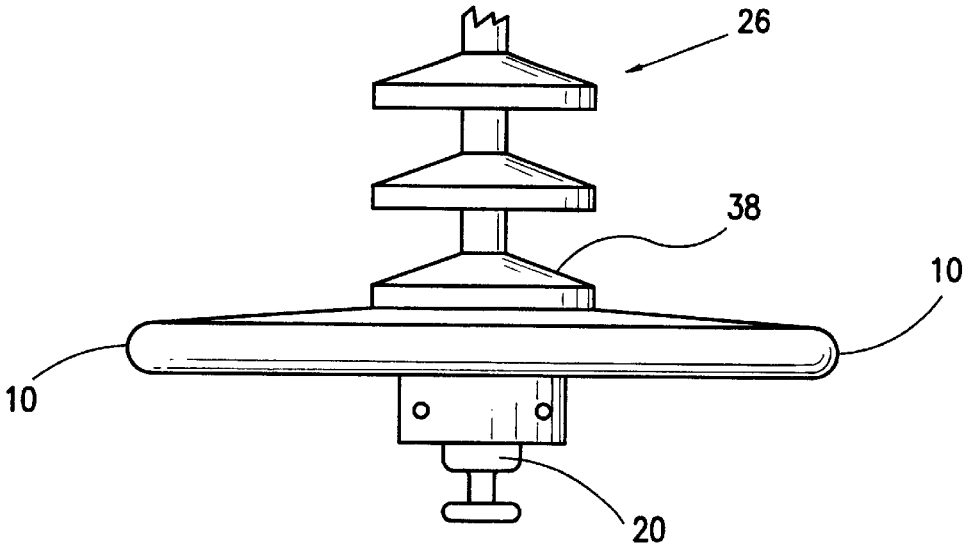
FIG. 5 is a side elevational view of the high voltage insulator, of the form shown in FIG. 4, with the complete invention (both split halves) attached.

When the insulator terminator device of the present invention is attached to the high voltage insulator 26, as described above and shown in FIG. 5, the action of the invention is to protect the portion 44 of high voltage insulator 26 adjacent to end fitting 20 and below the lowermost rain shed 38, from corrosion and erosion effects due to corona discharges and high surface leakage currents. This protective effect is due to the combined effect of semiconductor member 12 and conductive strength member 14 of the invention: Leakage currents are eliminated from portion 44 of high voltage insulator 26, because the conductivity of semiconductor member 12 is sufficient to allow such currents to be shunted through semiconductor member 12, as lower intensity volume current, to conductive strength member 14, and thence directly to the end fitting 20. Because the current flows through semiconductor member 12 as a volume current, rather than along the surface of portion 44 as a surface leakage current, the invention prevents corona discharges along portion 44, and thus prevents the ultraviolet radiation which can produce corrosion and erosion effects in portion 44, when such leakage currents are present. And because the conductivity of semiconductor member 12 is limited, rather than being a high conductivity, the semiconductor member 12 acts to limit the magnitude of each pulse of leakage current, thus helping to reduce erosion effects at other parts of high voltage insulator 26, including parts remote from the device of the present invention. In addition, the rounded, smooth curvature of the outer portion of each of split halves 10 assures that there are no points of high electric field strength on the outer edges of the invention, since such high field stress points could themselves be cites of corona discharges. The invention performs in this manner regardless of whether the high voltage insulator 26 is dry or wet with rain, because of the watertight nature of the interface between top of the insulator terminator device and the bottom 36 of rain shed 38.

Thus the overall effect of the use of the present invention, is to prolong the effective life of high voltage insulator 26, by reducing erosion and corrosion occurring near the end fitting 20 absent the present invention. The invention accomplishes this result because the above-described shunting effect of semiconductor member 12 and conductive strength member 14, together with the geometry of those elements, both removes high surface leakage current from the portion 44 of high voltage insulator 26, and prevents the existence of high electric field strength points along portion 44, while also avoiding creation of any such high field strength points on any portion of the present invention.

Those familiar with the art will appreciate that the invention may be employed in configurations other than the specific forms disclosed herein, without departing from the essential substance thereof.

For example, and not by way of limitation, although the preferred embodiment is formed of two split halves 10, which may be retrofitted to an existing high voltage insulator 26, it would of course be possible to manufacture a high voltage insulator with a single semiconductor disk and conductive surface device of the form of the present invention already attached around the base thereof, rather than having the invention be formed in split halves for attachment to an existing insulator.

And, although identical split halves 10 are found in the preferred embodiment, it would of course be possible to employ the invention in a form having a plurality of non-identical components which, when assembled together around the base of the high voltage insulator 26, form a rounded disk-shaped form, with a semiconductor element and a surface conductor element, substantially as in the assembled preferred embodiment.

Similarly, the invention does not of course require the use of any particular material for the fabrication of the semiconductor member 12 or the conductive strength member 14; alternate suitable materials may be used instead. For example, the material used in fabrication of semiconductor member 12 could have a conductivity greater than, or less than, 0.1 microSiemen/cm. A wide range of conductivity of semiconductor member 12 would be permissible; subject to the limitations that if said conductivity is too high, the semiconductor member 12 would not act to suitably attenuate the peak current during each pulse of leakage current; and a conductivity too low could cause erosion of semiconductor member 12 in the vicinity of point 16. An allowable range of conductivity for semiconductor member 12 would be extremely large, from about 0.0001 microSiemen/cm to about 100 Siemen/cm. However, the optimum range would be from about 0.001 microSiemen/cm to about 100 Siemen/cm.

It would also be possible to employ a device of substantially the form of the preferred embodiment, with suitable modifications, to either end of the insulator. Such a device could be installed at the upper end of the insulator, in which case the surface 34 of the device would be formed to fit the top surface of the topmost rain shed of the insulator.

The scope of the invention is defined by the following claims, including also all subject matter encompassed by the doctrine of equivalents as applicable to the claims.

I claim:

1. Insulator terminator device, for use with a high voltage power line insulator having a plurality of rain sheds projecting from the sides thereof and having a lower end fitting below the lowermost of said rain sheds, said insulator terminator device comprising:

(a) volume current conveyance means, connected to a portion of said insulator between said lowermost rain shed and said lower end fitting, for conveying a volume current from said portion of said insulator, through said volume current conveyance means, and for avoiding high electric field strengths in said means and on said portion of said insulator; and (b) surface current conduction and strength means, surrounding and connected to a portion of said volume current conveyance means, and connected to said lower end fitting, for conveying a surface current through said surface current conveyance means from said volume current conveyance means to said lower end fitting, and for avoiding high electric field strengths in the vicinity of said surface current conduction and strength means; and for providing mechanical strength for support of said volume current conveyance means.

2. The insulator terminator device of claim 1, wherein said volume current conveyance means comprises a semiconductor material.

3. The insulator terminator device of claim 2, wherein said semiconductor material is of the form of a disk having rounded edges and wherein said surface current conduction and strength means is a layer of metal covering the bottom, an outer edge, and an outer portion of the top of said disk of semiconductor material.

4. The insulator terminator device of claim 3, wherein said device is formed of identical split halves connected to said insulator and lower end fitting.

5. The insulator terminator device of claim 3, wherein said device is formed of a plurality of nonidentical sections connected to said insulator and lower end fitting.

6. The insulator terminator device of claim 2, wherein said semiconductor material is formed of a carbon-loaded resin.

7. The insulator terminator device of claim 1, wherein said surface current conduction and strength means is made of aluminum.

8. The insulator terminator device of claim 1, further comprising sealing means for achieving a watertight seal between an upper portion of said device and a bottom portion of said lowermost rain shed of said insulator.

9. Insulator terminator device, for use with a high voltage power line insulator having a plurality of rain sheds projecting from the sides thereof and having an upper end fitting above the uppermost of said rain sheds, said insulator terminator device comprising:

(a) volume current conveyance means, connected to a portion of said insulator between said uppermost rain shed and said upper end fitting, for conveying a volume current from said portion of said insulator, through said volume current conveyance means, and for avoiding high electric field strengths in said means and on said portion of said insulator; and (b) surface current conduction and strength means, surrounding and connected to a portion of said volume current conveyance means, and connected to said upper end fitting, for conveying a surface current through said surface current conveyance means from said volume current conveyance means to said upper end fitting, and for avoiding high electric field strengths in the vicinity of said surface current conduction and strength means; and for providing mechanical strength for support of said volume current conveyance means.

10. The insulator terminator device of claim 9, wherein said volume current conveyance means comprises a semiconductor material.

11. The insulator terminator device of claim 10, wherein said semiconductor material is of the form of a disk having rounded edges and wherein said surface current conduction and strength means is a layer of metal covering the top, an outer edge, and an outer portion of the bottom of said disk of semiconductor material.

12. The insulator terminator device of claim 11, wherein said device is formed of identical split halves connected to said insulator and upper end fitting.

13. The insulator terminator device of claim 11, wherein said device is formed of a plurality of nonidentical sections connected to said insulator and upper end fitting.

14. The insulator terminator device of claim 10, wherein said semiconductor material is formed of a carbon-loaded resin.

15. The insulator terminator device of claim 9, wherein said surface current conduction and strength means is made of aluminum.

16. The insulator terminator device of claim 9, further comprising sealing means for achieving a watertight seal between a bottom portion of said device and an upper portion of said uppermost rain shed of said insulator.

* * * * *